US009089761B2

(12) United States Patent
Tunstill et al.

(10) Patent No.: US 9,089,761 B2
(45) Date of Patent: Jul. 28, 2015

(54) WRESTLING HEADGEAR WITH INTEGRATED HEADPHONES

(71) Applicants: Bari Tunstill, Fishers, IN (US); Eric Silver, North Champlin, MN (US)

(72) Inventors: Bari Tunstill, Fishers, IN (US); Eric Silver, North Champlin, MN (US)

(73) Assignee: MATMUSIC LLC, Indianapolis, IN (US)

( * ) Notice: Subject to any disclaimer, the term of this patent is extended or adjusted under 35 U.S.C. 154(b) by 0 days.

(21) Appl. No.: 14/314,061

(22) Filed: Jun. 25, 2014

(65) Prior Publication Data

US 2015/0059068 A1 Mar. 5, 2015

Related U.S. Application Data

(63) Continuation of application No. 14/295,360, filed on Jun. 4, 2014, now abandoned.

(60) Provisional application No. 61/872,877, filed on Sep. 3, 2013.

(51) Int. Cl.

| | |
|---|---|
| ***A63B 71/10*** | (2006.01) |
| ***A42B 3/16*** | (2006.01) |
| ***A42B 3/30*** | (2006.01) |

(52) U.S. Cl.

CPC . *A63B 71/10* (2013.01); *A42B 3/16* (2013.01); *A42B 3/30* (2013.01); *A63B 2244/108* (2013.01)

(58) Field of Classification Search

CPC ..... A63B 71/10; A63B 2244/108; H04R 1/1066; H04R 1/1008; H04R 5/0335; H04R 1/1016; H04R 1/105; H04R 1/1075; H04R 1/1058; H04R 2420/07; H04R 1/10; H04M 1/05; A42B 1/068; A42B 3/16; A42B 3/324

See application file for complete search history.

(56) References Cited

U.S. PATENT DOCUMENTS

| | | | | | |
|---|---|---|---|---|---|
| 1,571,471 | A | * | 2/1926 | Galayda | 381/379 |
| 2,447,470 | A | * | 8/1948 | Valentine | 381/372 |
| 2,609,544 | A | * | 9/1952 | Berg | 2/209 |
| 2,898,596 | A | * | 8/1959 | Keen | 2/421 |
| 3,513,482 | A | * | 5/1970 | Holden | 2/421 |
| 3,588,914 | A | * | 6/1971 | Ihnat, Jr. | 2/421 |
| 3,596,288 | A | * | 8/1971 | Marchello | 2/421 |
| 3,728,741 | A | * | 4/1973 | Lepor | 2/209 |
| 4,023,642 | A | * | 5/1977 | Korn | 181/175 |
| 4,037,273 | A | * | 7/1977 | Labaire | 2/209 |
| 4,538,034 | A | * | 8/1985 | French | 381/383 |
| 4,551,861 | A | * | 11/1985 | Marchello | 2/425 |
| 4,710,985 | A | * | 12/1987 | Dubner et al. | 2/425 |
| 4,802,245 | A | * | 2/1989 | Miano | 2/209 |
| 4,821,345 | A | * | 4/1989 | Marchello | 2/425 |
| 5,228,143 | A | * | 7/1993 | Marchello | 2/425 |
| 5,504,945 | A | * | 4/1996 | Purnell | 2/425 |

(Continued)

*Primary Examiner* — Bobby Muromoto, Jr.

(74) *Attorney, Agent, or Firm* — Joseph E. Maenner; Maenner & Associates, LLC

(57) ABSTRACT

In described embodiments, a wrestling headgear assembly is disclosed. The headgear includes a first ear piece and a second earpiece connected to the first earpiece by at least two connections. Each of the first and second earpieces comprises a generally planar inner layer constructed from a compressible material. The inner layer has a generally central inner opening extending therethough. A generally convex outer layer is fixedly attached to the inner layer. The outer layer is constructed from a rigid material and includes a plurality of outer openings aligned with the inner opening. A sound speaker is located between the inner layer and the outer layer such that the speaker is aligned with the inner opening.

18 Claims, 10 Drawing Sheets

(56) References Cited

U.S. PATENT DOCUMENTS

| | | | | |
|---|---|---|---|---|
| 5,551,090 | A * | 9/1996 | Thompson | 2/209 |
| 5,685,021 | A * | 11/1997 | Tsujino | 2/425 |
| 5,881,393 | A * | 3/1999 | Marchello | 2/425 |
| 6,058,516 | A * | 5/2000 | Purnell | 2/425 |
| 6,289,522 | B1 * | 9/2001 | Jones et al. | 2/425 |
| 6,564,395 | B2 * | 5/2003 | Keen | 2/425 |
| 6,715,156 | B1 * | 4/2004 | Purnell | 2/425 |
| 6,986,167 | B1 * | 1/2006 | Coutant et al. | 2/425 |
| 7,013,018 | B2 * | 3/2006 | Bogeskov-Jensen | 381/381 |
| 7,146,650 | B2 * | 12/2006 | Shalom | 2/209 |
| 7,278,734 | B2 * | 10/2007 | Jannard et al. | 351/158 |
| 7,428,763 | B2 * | 9/2008 | Hightower | 5/636 |
| 8,006,320 | B1 * | 8/2011 | Rohbani | 2/209 |
| 8,291,520 | B2 * | 10/2012 | Lukens | 2/423 |
| 8,534,290 | B2 * | 9/2013 | Karrman | 128/867 |
| 8,627,824 | B2 * | 1/2014 | Koehler | 128/858 |
| 8,651,229 | B2 * | 2/2014 | Franzen | 181/129 |
| 2002/0106100 | A1 * | 8/2002 | Kao | 381/381 |
| 2003/0015368 | A1 * | 1/2003 | Cybulski et al. | 181/131 |
| 2003/0128838 | A1 * | 7/2003 | Lenz et al. | 379/430 |
| 2004/0213428 | A1 * | 10/2004 | Lenhard-Backhaus | 381/370 |
| 2006/0158608 | A1 * | 7/2006 | Lin | 351/158 |
| 2006/0198543 | A1 * | 9/2006 | Vaerum et al. | 381/375 |
| 2009/0044315 | A1 * | 2/2009 | Belanger et al. | 2/414 |
| 2009/0213323 | A1 * | 8/2009 | Hermanson et al. | 351/158 |
| 2011/0103636 | A1 * | 5/2011 | Pelland et al. | 381/380 |
| 2011/0194721 | A1 * | 8/2011 | Schmidt et al. | 381/370 |

* cited by examiner

WRESTLING HEADGEAR WITH INTEGRATED HEADPHONES

CROSS-REFERENCE TO RELATED APPLICATION

The present application claims priority to U.S. Provisional Patent Application Ser. No. 61/872,877, which was filed on Sep. 3, 2013, and which is incorporated herein by reference in its entirety.

BACKGROUND OF THE INVENTION

1. Field of the Invention

The present invention relates to wrestling headgear, and, in particular, to wrestling headgear with sound speakers integrated therein.

2. Description of the Related Art

Wrestlers, such as Greco-roman, freestyle, folkstyle wrestlers, can wear protective headgear when they wrestle in order to protect their heads, and especially their ears, from injury. The headgear is worn relatively tightly on the head and is secured by adjustable straps. Prior to a wrestling match, however, many wrestlers like to listen to music through headphones in order to relax themselves, or to otherwise prepare themselves for competition. To do so, however, they must remove their protective headgear in order to don headphones and then, immediately prior to the match, must remove the headphones and replace the protective headgear on their head.

It would be beneficial to provide a device that allows the wrestler, while wearing his/her protective headgear, to be able to listen to music through headphones integrated with the headgear, prior to competition, as well as during training.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is a wrestling headgear assembly comprising a first ear piece and a second earpiece connected to the first earpiece by at least two connections. Each of the first and second earpieces comprises a generally planar inner layer constructed from a compressible material. The inner layer has a generally central inner opening extending therethough. A generally convex outer layer is fixedly attached to the inner layer. The outer layer is constructed from a rigid material and includes a plurality of outer openings aligned with the inner opening. A sound speaker is located between the inner layer and the outer layer such that the speaker is aligned with the inner opening.

In another embodiment, the present invention is a wrestling headgear assembly comprising a first ear piece and a second earpiece connected to the first earpiece by at least two connections. Each of the first and second earpieces comprises an inner layer constructed from a compressible material. The inner layer has an ear hole extending therethough. A sound speaker is located proximate to the inner layer such that sound generated by the speaker is transmitted through the ear hole.

Further, the present invention provides a wrestling headgear assembly comprising a first ear piece and a second earpiece connected to the first earpiece by at least two connections. Each of the first and second earpieces comprises a sound speaker coupled to the earpiece such that the speaker is movably located between a first position and a second position such that, when the speaker is at least in the second position, the speaker is located away from the ear.

BRIEF DESCRIPTION OF THE DRAWINGS

Other aspects, features, and advantages of the present invention will become more fully apparent from the following detailed description, the appended claims, and the accompanying drawings in which like reference numerals identify similar or identical elements.

DETAILED DESCRIPTION

Figure 2:
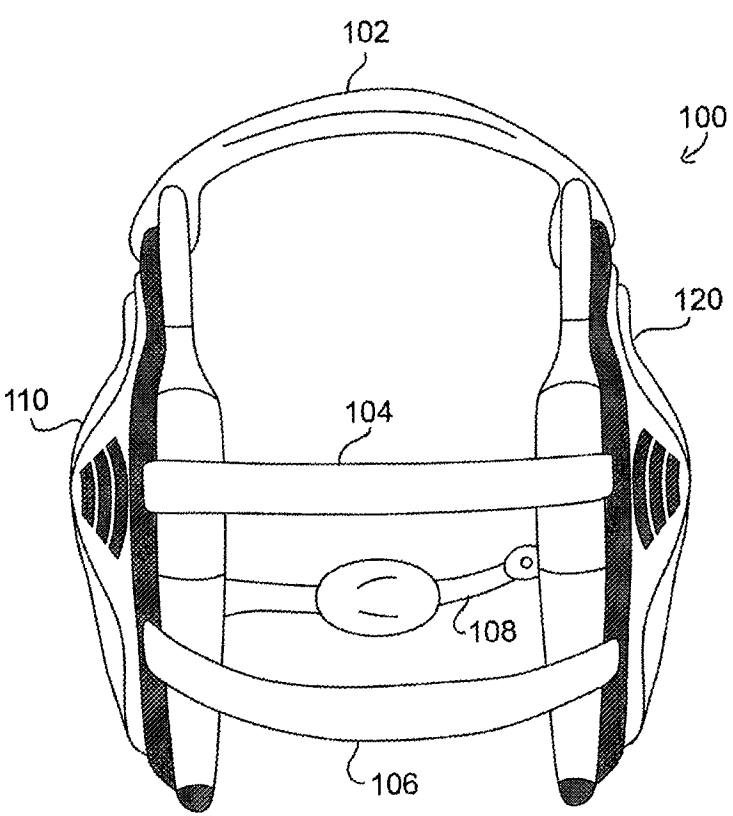
FIG. 2 shows a rear elevational view of the wrestling headgear assembly shown in FIG. 1.

In the drawings, like numerals indicate like elements throughout. Certain terminology is used herein for convenience only and is not to be taken as a limitation on the present invention. The terms "front", "rear", "left" and "right" refer, respectively, to front, rear, left, and right sides of a wrestler's head and to sides of the inventive device when the device is worn on the wrestler's head. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Also for purposes of this description, the terms "couple," "coupling," "coupled," "connect," "connecting," or "connected" refer to any manner known in the art or later developed in which energy is allowed to be transferred between two or more elements, and the interposition of one or more additional elements is contemplated, although not required. Conversely, the terms "directly coupled," "directly connected," etc., imply the absence of such additional elements.

A wrestling headgear assembly according to the present invention includes self-contained sound speakers for each ear that allow the wearer to listen to music or other sounds through the sound speakers without having to remove the headgear assembly.

Referring to FIGS. 1-12, a wrestling headgear assembly 100 according to an exemplary embodiment of the present invention is shown. Headgear assembly 100 includes a left earpiece 110 and a right earpiece 120. Sound speakers 180, 182 (shown in FIGS. 10 and 11, respectively), respectively, are attached to each of left earpiece 110 and right earpiece 120 to provide sound to a wearer while the wearer is wearing headgear assembly 100.

Figure 1:
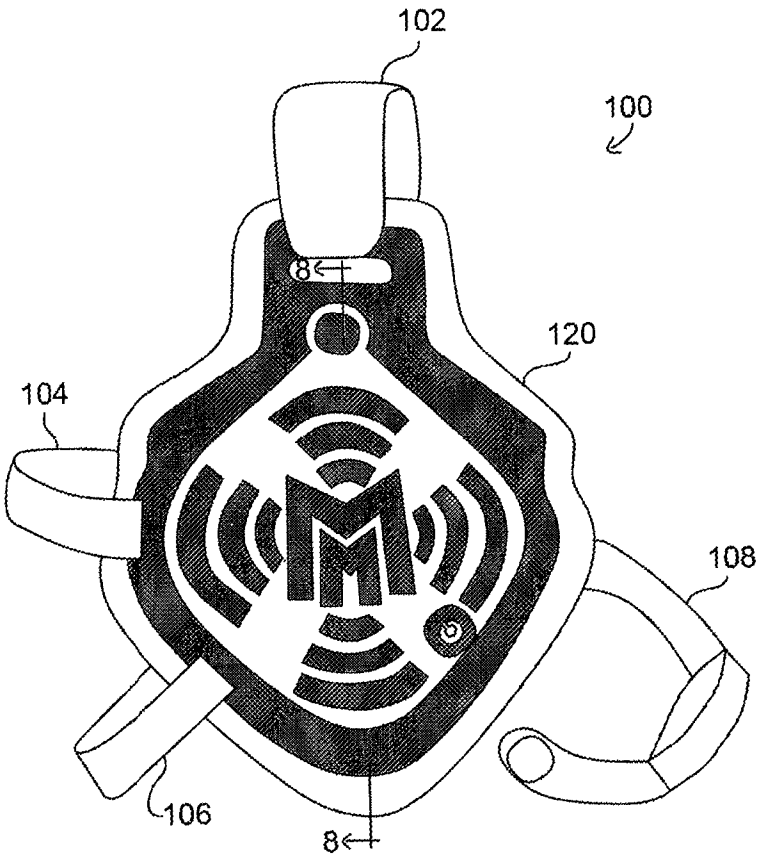
FIG. 1 shows a right side elevational view of a wrestling headgear assembly according to an exemplary embodiment of the present invention.

Referring to FIGS. 1 and 2, left earpiece 110 and right earpiece 120 are connected to each other by a top strap 102, an upper rear strap 104, a lower rear strap 106, and a chin strap 108. All of straps 102, 104, 106, 108 are adjustable according to strap adjustments that are well-known in the art. Optionally, straps 102, 104, 106, 108 may be removable. Additionally, in the exemplary embodiment shown, the right side of chin strap 108 is releasably connected to right earpiece 120 to facilitate securing and removal of headgear assembly 100 by a user.

Figure 3:
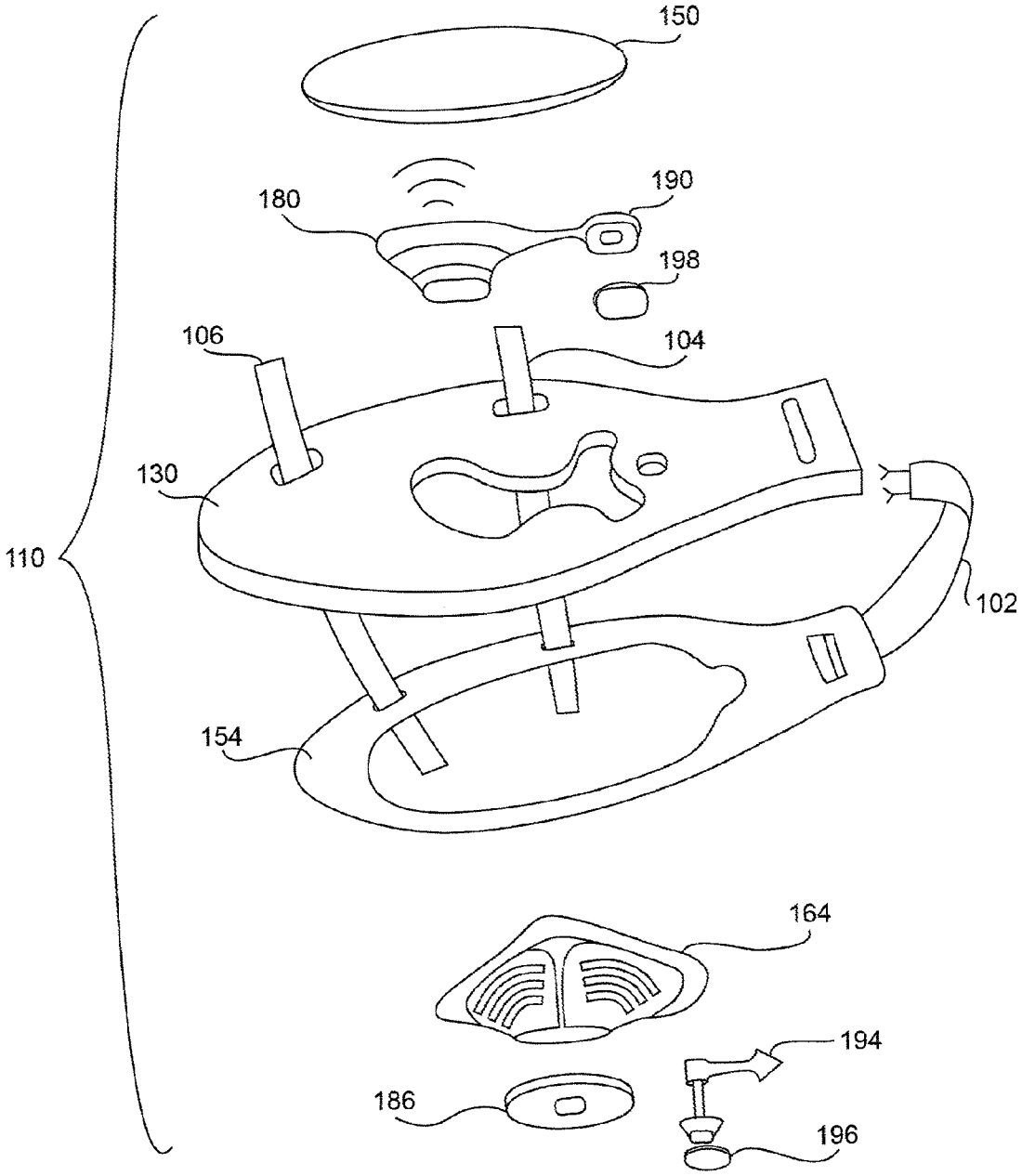
FIG. 3 shows an exploded perspective view of an earpiece in the headgear assembly shown in FIG. 1.
Figure 4:
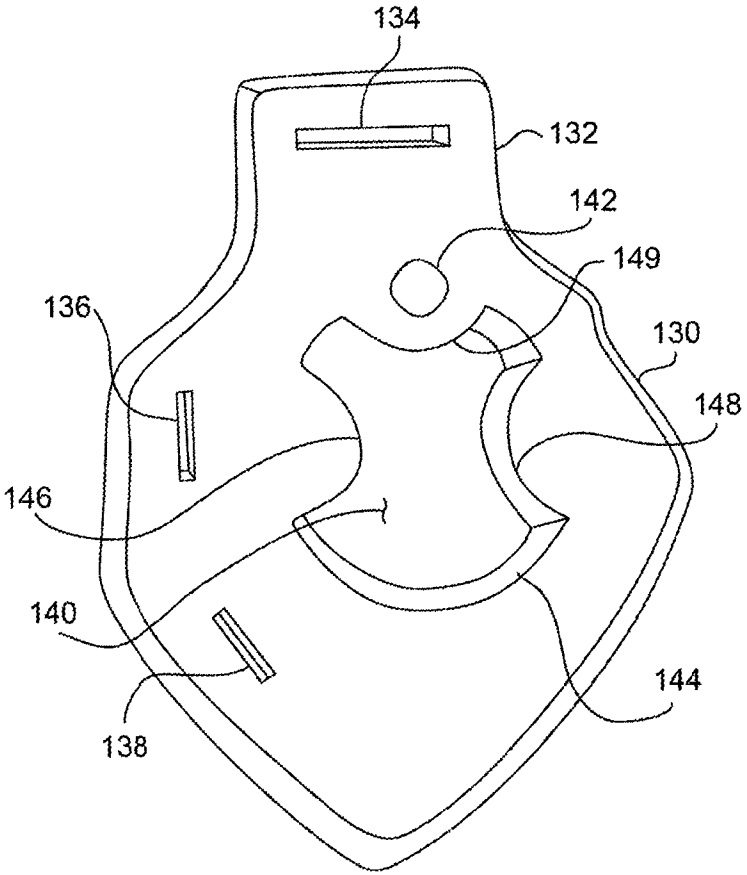
FIG. 4 shows a side elevational view of an inner layer of the earpiece shown in FIG. 3.

Each of left and right earpiece 110, 120, respectively include the same elements, and will be described below with reference to left earpiece 110 only for clarity. Referring to FIGS. 3 and 4, left earpiece 110 includes an inner layer 130 that, when worn, is directly against the wearer's head and ear. Inner layer 130 may be formed from a compressible material, such as, for example, an open cell foam. The material may be a generally planar shape having a thickness of approximately one quarter inch.

Inner layer 130 may be approximately diamond shaped with a tab 132 extending from a top portion thereof. Tab 132 includes a slot 134 to enable top strap 102 to be inserted therethrough. A rear portion of inner layer 130 also includes a top slot 136 and a bottom slot 138 to enable upper rear strap 104 and lower rear strap 106 to be inserted therethrough, respectively.

Inner layer 130 includes a generally central inner opening 140 extending therethrough. Inner opening 140 is generally aligned with the wearer's ear when wrestling headgear assembly 100 is being worn on the wearer's head. A generally circular opening 142 is located above inner opening 140. Circular opening 142 is used to secure sound speaker 180 to left earpiece 110.

Inner opening 142 has a generally concave lower wall 144, a generally convex rear wall 146, a generally convex front wall 148 and a generally convex top wall 149. Generally convex top wall 149 generally circumscribes a portion of circular opening 142.

A fabric material 150, shown in FIG. 3, is adjacent to inner layer 130 and extends over inner opening 142. Fabric material 150 is constructed from a generally puncture and tear resistant material, such as, for example, a flexible material, such as Superfabric™, manufactured by Higher Dimension Materials, Inc. of Oakdale, Minn." Fabric 150 provides a layer of protection between speaker 180 and the wearer's ear.

Figure 5:
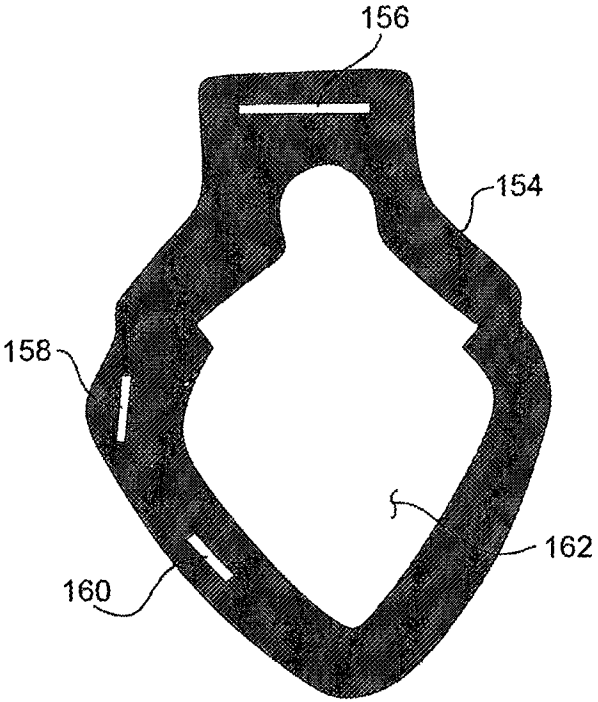
FIG. 5 shows a side elevational view of a middle layer of the earpiece shown in FIG. 3.

A middle layer 154, shown in FIG. 5, is adjacent to inner layer 130, with fabric material 150 at least partially separating middle layer 154 from inner layer 130. Middle layer 154 may be a rigid material constructed from a hard plastic or other suitable rigid material.

Middle layer 154 may be fixedly secured to inner layer 130, such as by an adhesive (not shown), so that fabric 150 is sandwiched between inner layer 130 and middle layer 154.

Middle layer 154 includes a plurality of slots 156, 158, 160 that align with slots 134, 136, 138, respectively, to allow straps 102, 104, 106, respectively, to be inserted therethrough. Middle layer 154 also includes a generally central middle opening 162 that generally aligns with both central inner opening 140 and circular opening 142. Middle opening 162 is generally diamond shaped to accommodate both central inner opening 140 and circular opening 142.

Figure 6:
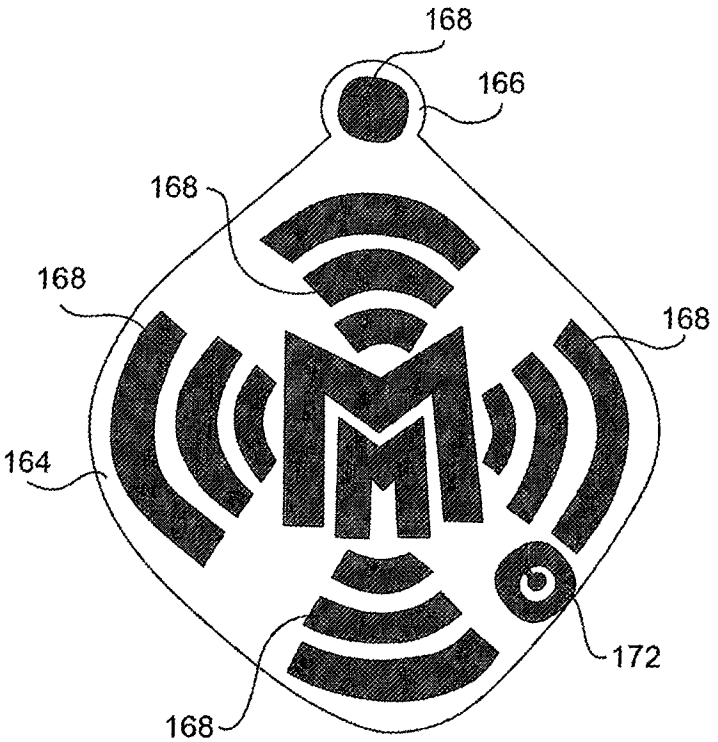
FIG. 6 shows a side elevational view of an outer layer of the earpiece shown in FIG. 3.
Figure 7:
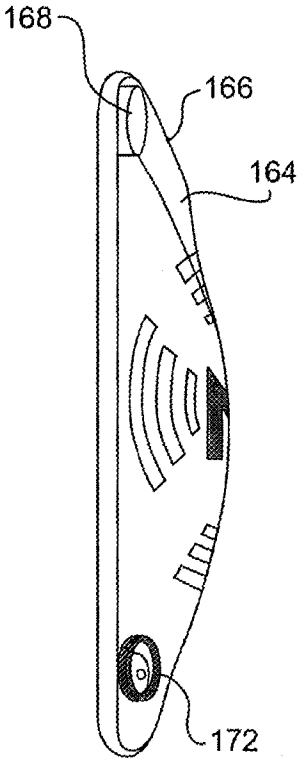
FIG. 7 shows a rear elevational view of the outer layer shown in FIG. 6.
Figure 10:
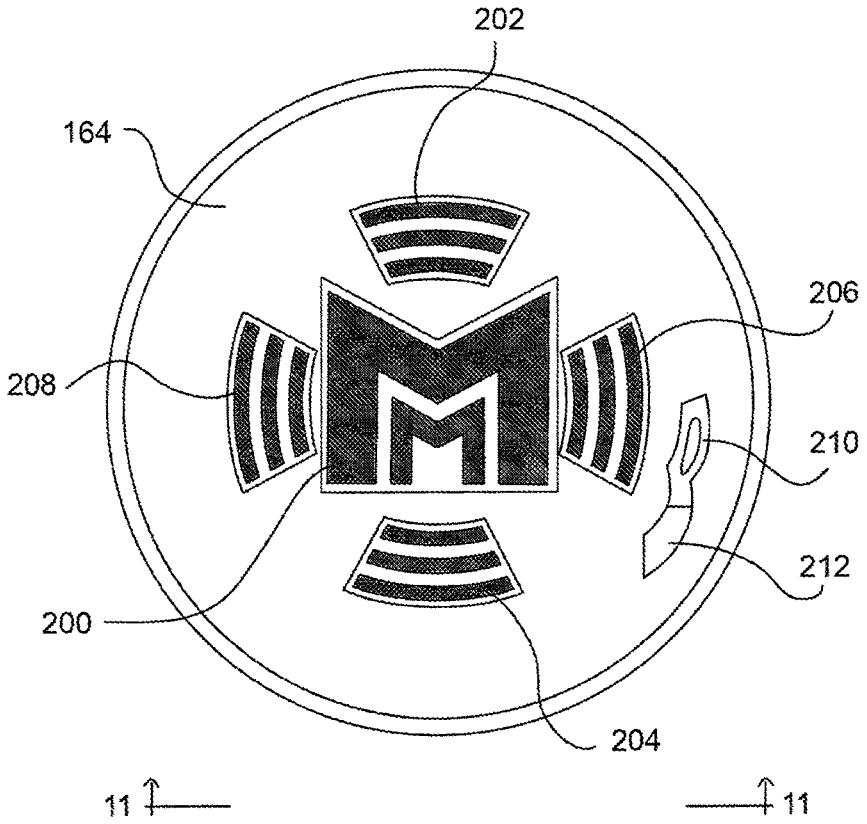
FIG. 10 shows a side elevational view of speaker controls for the wrestling headgear shown in FIG. 1.

An outer layer 164, shown in FIGS. 6 and 7, is located over middle layer 154 and covers middle opening 162. Outer layer 164 is constructed from a rigid material, such as, for example, a high density polymer. Outer layer 164 is generally convex in shape and houses a sound speaker 180 therein between outer layer 164 and middle layer 154. Outer layer 164 has a generally diamond shape with a tab 166 extending upwardly therefrom. Tab 166 includes a through vent opening 168 that is aligned with middle opening 162 in middle layer and circular opening 142 in inner layer 130.

Figure 8:
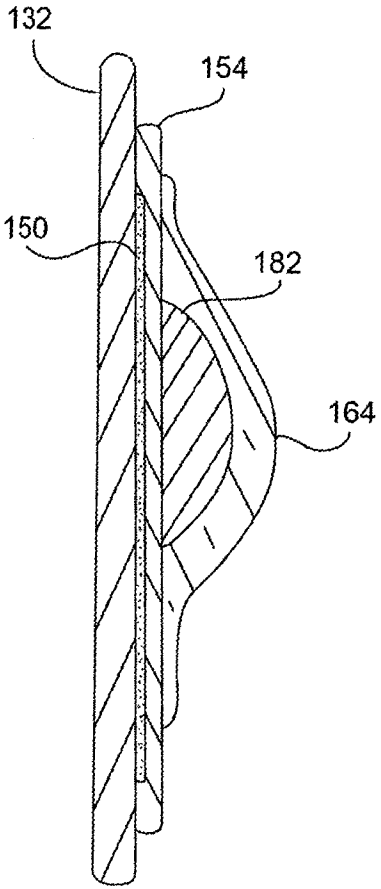
FIG. 8 shows a sectional view of the right earpiece of the wrestling headgear shown in FIG. 1.

Outer layer 164 includes a plurality of generally concentric vent openings 168 extending circumferentially around a central portion 170. When in a first position, sound speaker 180 is generally centered within central portion 170 such that concentric vent openings 168 extend around sound speaker 180. A snap 172 is located toward the bottom front portion of outer layer 164. Snap 172 is used to releasably secure chin strap 108 to outer layer 164. FIG. 8 shows a sectional view of left earpiece 110, showing speaker 180 centered within central portion 170.

Figure 9:
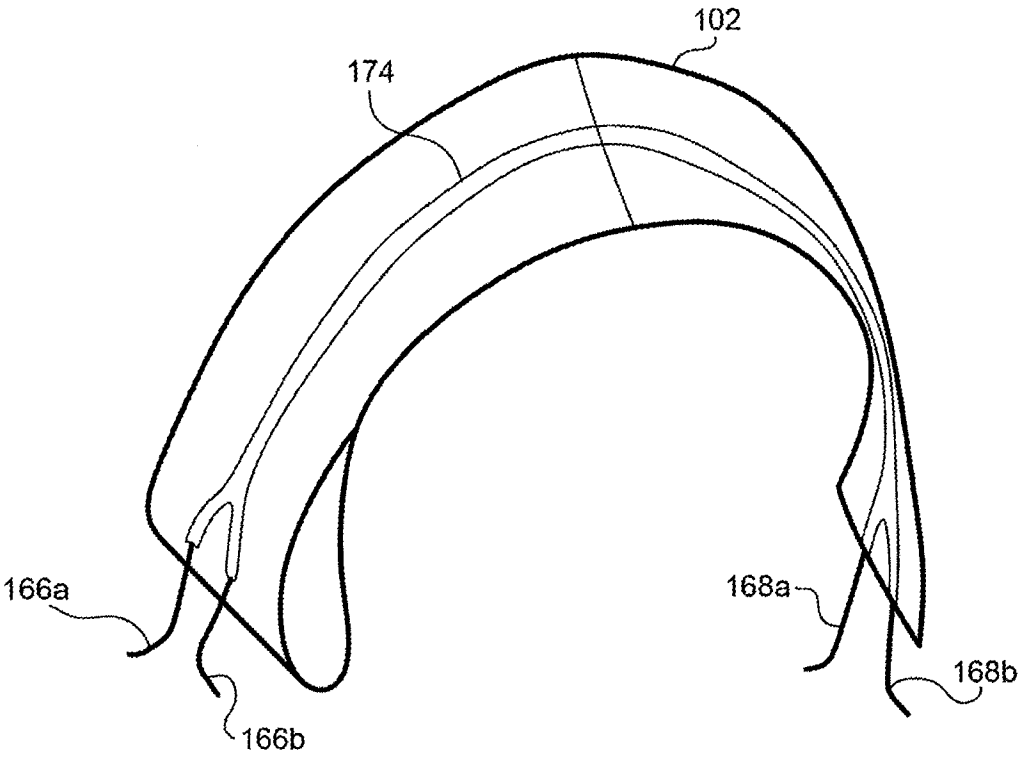
FIG. 9 shows a perspective view of a top strap of the wrestling headgear shown in FIG. 1.

Top strap 102, shown in FIG. 9, includes an electrical cable 164 extending therethrough. Cable 164 includes electrical leads 166*a*, 166*b* that provide an electrical connection to speaker 180 (not shown in FIG. 9) and leads 168*a*, 168*b* that provide an electrical connection to speaker 182 (not shown in FIG. 9). While cable 164 is shown, those skilled in the art will recognize that speakers 180, 182 can be connected wirelessly, such as through a blue tooth or other wire-free connection.

Sound speakers 180, 182, may be known speakers that employ known and as-yet unknown electronic components. For example, speaker 180 may include a jack plug (not shown) to allow a physical connection to an electronic component, such as an external MP3 player. Jack plug may accommodate a ¼" jack, a ⅛" jack, or any other type of jack. Optionally, speaker 182 may include a wireless/blue tooth component.

Still optionally, speaker 182 may include an internal MP3 player or other type of sound input device, song select/volume control buttons, on/off buttons, and other controls typically associated with self-contained sound generating headphones.

While certain electronic components are described above as being associated with either speaker 180 or speaker 182, those skilled in the art will recognize that the electronic components can be associated with either or both speakers 180, 182. In an exemplary embodiment, shown in FIGS. 10, 11 and 11A, controls to operate speakers 180, 182 may be located on and accessible from an exterior side of outer layer 164. The controls may include an ON/OFF switch 200 that is toggled between an "on" position and an "off" position by depressing switch 200. When in the "on" position, Bluetooth or other wireless access is automatically paired with device 100. Further, if device 100 includes an MP3 player, or other storage device, ON/OFF switch 200 also functions as a Play/Pause switch. Optionally, ON/OFF switch 200 must be pressed for a predetermined period of time, such as, for example, 3 seconds, in order to power device 100 on. An LED 201 lights up to indicate that the controls are powered "ON" and LED is unlit when the controls are powered "OFF".

Additionally, the controls may include a "volume up" button 202 and a "volume down" button 204 that are operated by depressing the respective buttons 202, 204. The controls may also include a "forward" button 206 and a "back" button 208 if device 100 includes an MP3 player. Still optionally, device 100 may alternatively/additionally include a USB port 210 with a cover 212 to provide a power and/or other outside electronic connection to speakers 180, 182.

Figure 11:
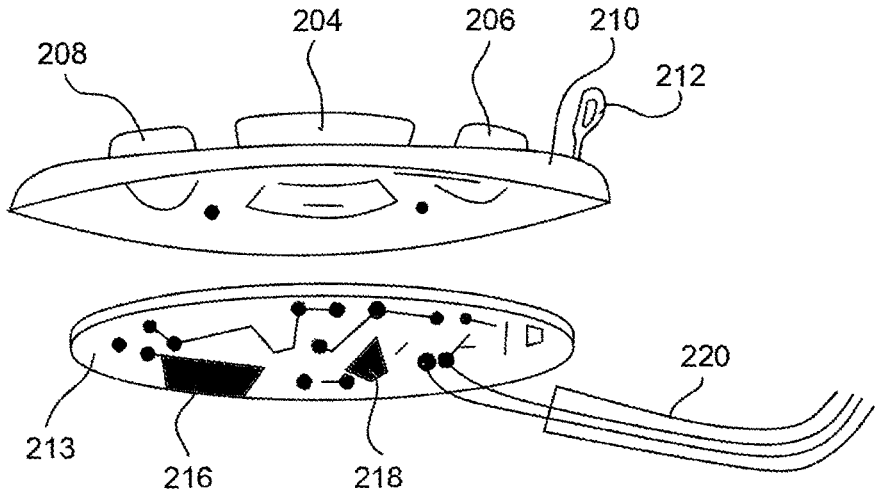
FIG. 11 shows an exploded view of the speaker controls and an electronic circuit board of the wrestling headgear assembly shown in FIG. 1.
Figure 11A:
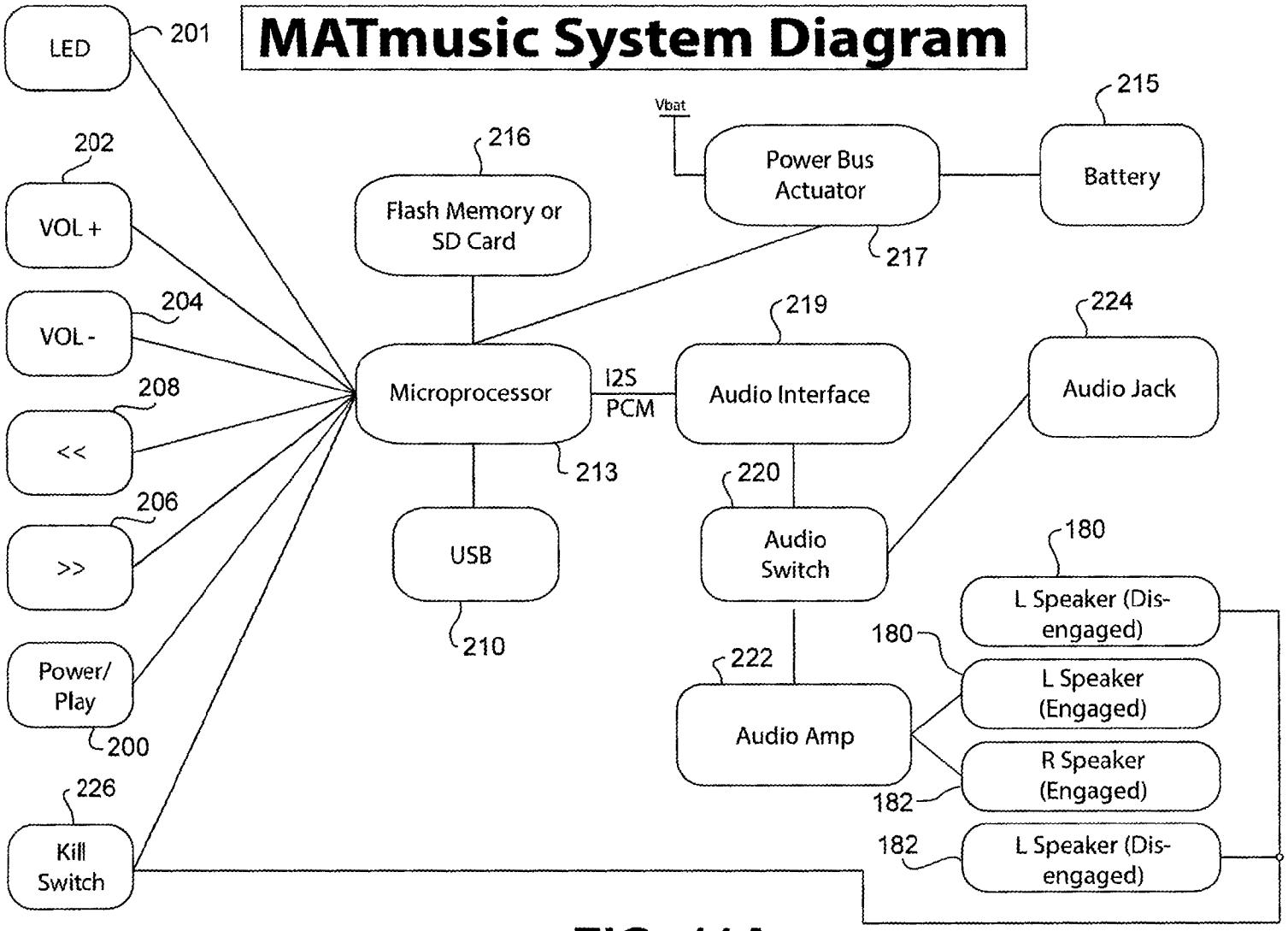
FIG. 11A is an exemplary electrical schematic diagram for the wrestling headgear assembly according to the present invention.

As shown in FIG. 11, a circuit board with a processor 213 is provided inside outer layer 164 to provide controls for buttons 200-208 and USB port 210. If device 100 includes an MP3 player, circuit board also includes a storage medium 216 that can electronically store music or other MP3 files. A microphone chip 218 is also provided to allow recording onto device 100. Wires 220 electronically connect processor 213 to speakers 180, 182.

A battery 215 powers the electronic components through a power bus actuator 217 that electrically connects battery 215 to microprocessor 213.

Figure 12:
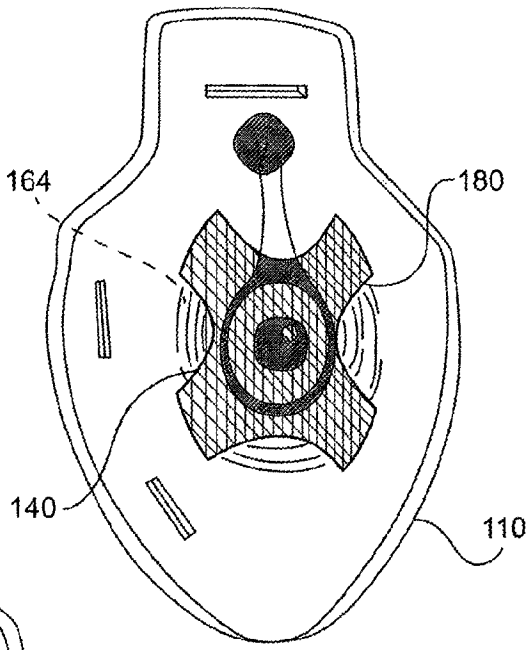
FIG. 12 shows a side elevational view of a left earpiece, from inside the inner layer looking outward, of the wrestling headgear shown in FIG. 1.
Figure 13:
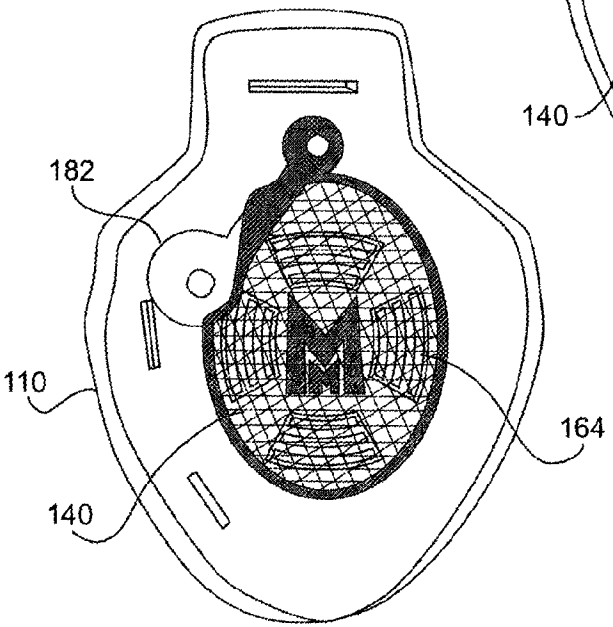
FIG. 13 shows a side elevational view of a right earpiece, from outside the outer layer looking inward, of the wrestling headgear shown in FIG. 1.

Speakers 180, 182 may be fixedly connected within a respective ear piece, such as earpiece 110, as shown in FIG. 12 (for ease of description, only speaker 180 will be described, although the same description pertains to speaker 182). Alternatively, speaker 180 may be movable from a first position between outer layer 164 and inner layer 110, wherein speaker 180 is aligned with inner opening 140, as shown in FIG. 12, and a second position, wherein speaker 180 is not aligned with inner opening 140, as shown in FIG. 13.

Speakers 180, 182 are electronically connected to microprocessor 213 via an audio interface 219, an audio switch 220, and an audio amplifier 222. Audio switch 220 toggles between audio amplifier 222 and an audio jack 224 that allows the user to plug in an external device to play music or other sounds into speakers 180, 182.

Figure 14A:
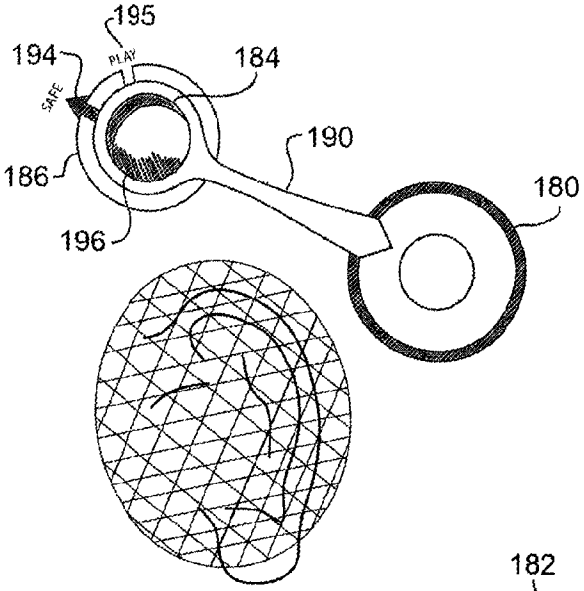
FIG. 14A shows a side elevational view of a speaker of the wrestling headgear shown in FIG. 1 in a second position away from a user's ear.
Figure 14:
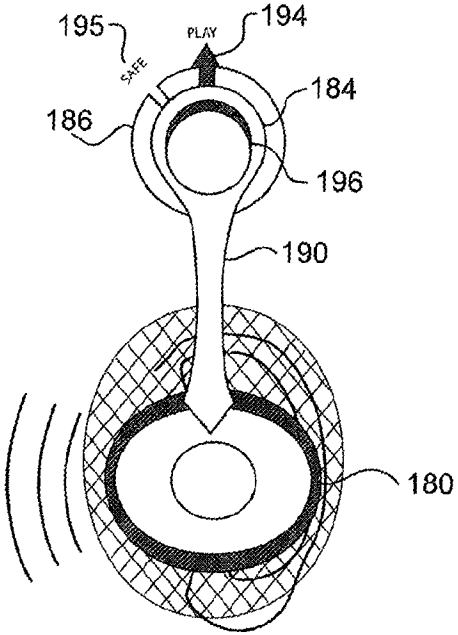
FIG. 14 shows a side elevational view of a speaker of the wrestling headgear shown in FIG. 1 in a first position over a user's ear.

To enable speaker 180 to move between the first position and the second position, speaker 180 can be mounted on a pivot assembly 184, as shown in FIGS. 14 and 14A, which show speaker 180 in the first position, and the second position, respectively. When speaker 180 is moved to the "OFF" position, a kill switch 226 is physically engaged by speaker 180, which opens a switch on microprocessor 213, powering off the electronic components.

Figure 15:
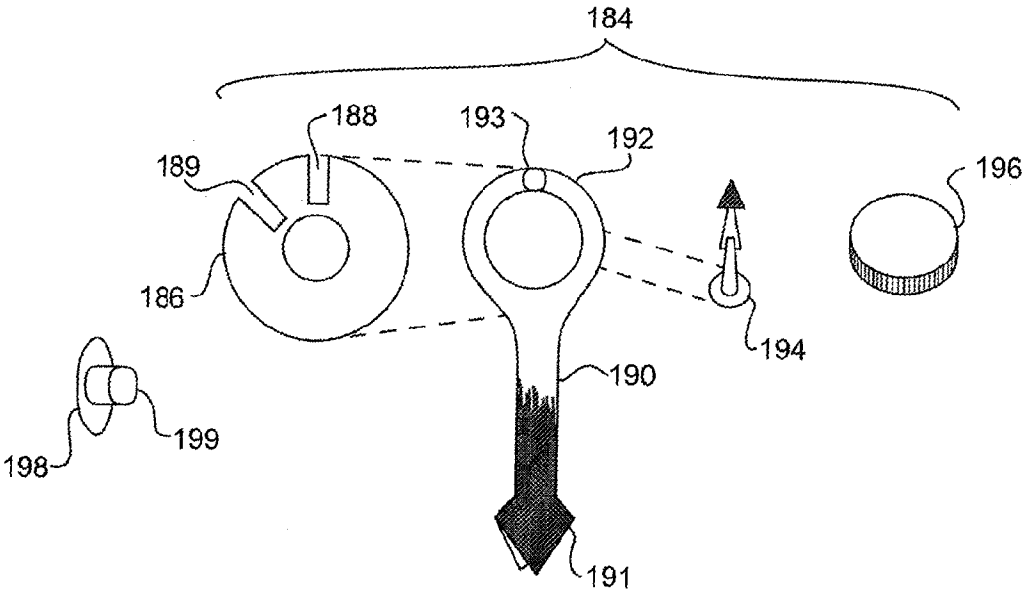
FIG. 15 shows an exploded perspective view of a speaker adjusting mechanism for use in the wrestling headgear shown in FIG. 1.

An exploded view of pivot assembly 184 is shown in FIG. 15. Pivot assembly 184 includes a detent plate 186 having a first detent slot 188 and a second detent slot 189. A lever arm 190 has a first end 191 connected to speaker 180 and a second end 192 rotatably connected to detent plate 186. Second end 192 includes a detent pin 193 that extends into each of detent slot 188, 189, depending on the position of pivot assembly 184, to releasably engage second end 192 of lever arm 190 with detent plate 186.

A position indicator 194 moves with lever arm 190 and provides a visual indication of where speaker 180 is positioned. Indicia 195 (shown in FIGS. 14 and 14A) provides additional visual indication of where speaker 180 is positioned. An adjustment knob 196, fixedly coupled to lever arm 190, may be used by the wearer to move lever arm 190 and speaker 180 between the first position and the second position. A retaining pin 198 is located on the inside of outer layer 164 and includes a nub 199 that passes through vent opening 168 in outer layer 164, detent plate 186, and pivot arm 190 and is secured to adjustment knob 196 to retain pivot assembly 184 onto ear piece 110.

In order to allow speaker 180 to pivot to the second position, central inner opening 140 and central middle opening 162 are large enough to accommodate speaker 180 and lever arm 190 as speaker 180 moves between the first position and the second position.

An alternative embodiment of a movable speaker assembly 300 is mounted in an earpiece 301, shown in FIGS. 16-21. Speaker assembly 300 is movable between an "ON" position, in which a speaker 302 is in a position (shown in FIGS. 16-18) to play music to a user and an "OFF" position in which speaker 302 is not in a position (shown in FIGS. 19-21) to play music to the user.

Figure 16:
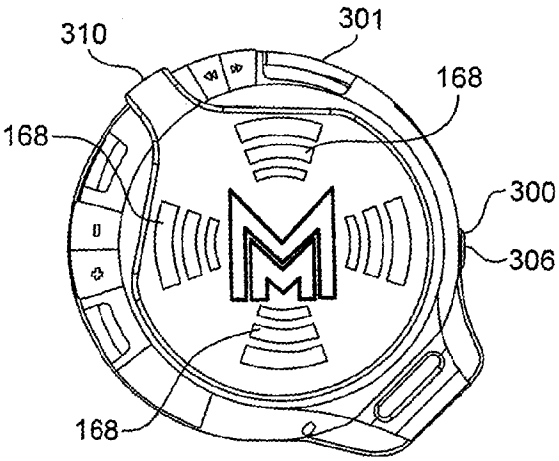
FIG. 16 is an exterior elevational view of an alternative embodiment of an ear piece for use with the wrestling headgear according to the present invention, with a speaker inside the earpiece in an "on" position.
Figure 17:
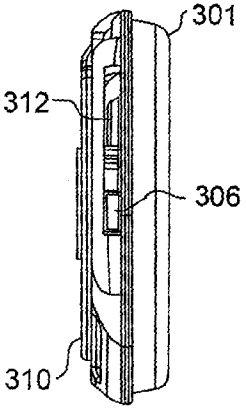
FIG. 17 is a side elevational view of the earpiece shown in FIG. 16.
Figure 18:
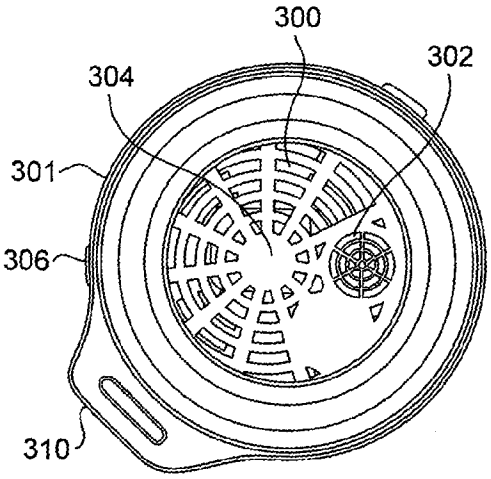
FIG. 18 is an inside elevational view of the earpiece shown in FIG. 16.
Figure 19:
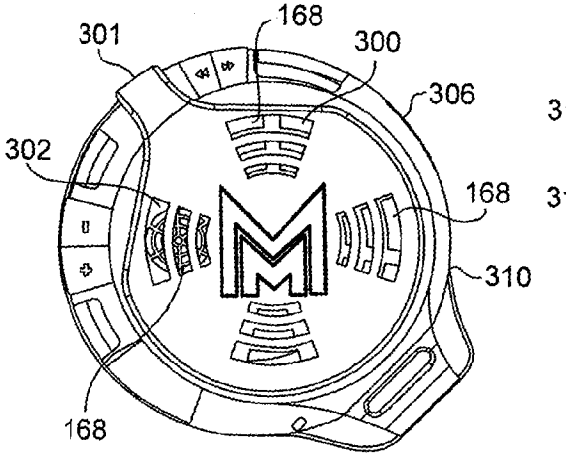
FIG. 19 is an exterior elevational view of the earpiece shown in FIG. 16, with the speaker in an "off" position.
Figure 20:
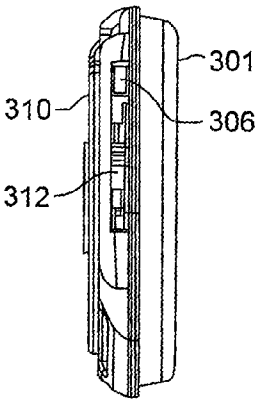
FIG. 20 is a side elevational view of the earpiece shown in FIG. 19.
Figure 21:
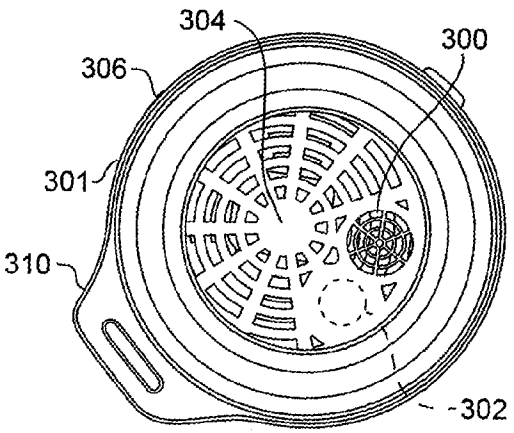
FIG. 21 is an inside elevational view of the earpiece shown in FIG. 19.

Speaker 302 is mounted in a central portion 304 of earpiece 301 such that a lever 306 can be moved between the position shown in FIGS. 16-18 and the position shown in FIGS. 19-21 to pivot speaker 302 between the "ON" position and the "OFF" position. Speaker 302 is mounted within earpiece 301 in the same configuration as speaker 180 is mounted relative to outer layer 164, middle layer 154 , and inner layer 130.

When speaker 302 is in the "ON" position, as shown in FIG. 18, vent openings 168 (shown in FIG. 16) are closed to retain sound generated from speaker 302 inside earpiece 301. When speaker 302 is in the "OFF" position, as shown in phantom lines in FIG. 21, vent openings 168 (shown in FIG. 19) are open to allow the user to hear external sounds, and also to provide ventilation to the inside portion of earpiece 302.

An outer layer 310 includes a cutout 312 (shown in FIGS. 17 and 20) formed therein to allow lever 306 to move between the "ON" position (shown in FIG. 17) and the "OFF" position (shown in FIG. 20). Also, when lever 306 is in the "OFF" position, kill switch 226 (shown in FIG. 11A) is engaged, deactivating speaker assembly 300 so that no sound is produced from speaker assembly 300.

Speaker 302 is electrically connected to microprocessor 213, similar to speakers 180, 182 as discussed above, and operates in a manner similar to speakers 180, 182. While only one earpiece 301 is discussed, those skilled in the art will recognize that both left and right earpieces are contemplated in this embodiment.

It will be further understood that various changes in the details, materials, and arrangements of the parts which have been described and illustrated in order to explain the nature of this invention may be made by those skilled in the art without departing from the scope of the invention as expressed in the following claims.

The invention claimed is:

1. A wrestling headgear assembly comprising:
a first ear piece; and
a second earpiece connected to the first earpiece by at least two connections, wherein each of the first and second earpieces comprises:
a generally planar inner layer constructed from a compressible material, wherein the inner layer has a generally central inner opening extending therethough;
a generally convex outer layer fixedly attached to the inner layer, wherein the outer layer is constructed from a rigid material, and wherein the outer layer includes a plurality of outer openings aligned with the inner opening; and
a sound speaker located between the inner layer and the outer layer such that the speaker is aligned with the inner opening.

2. The wrestling headgear assembly according to claim 1, wherein the sound speaker is movably disposed between a first position between the inner layer and the outer layer such that the speaker is aligned with the inner opening and a second position such that the speaker is not aligned with the inner opening.

3. The wrestling headgear assembly according to claim 2, wherein, when the speaker is in the second position, the speaker is not between the inner layer and the outer layer.

4. The wrestling headgear assembly according to claim 2, further comprising a first detent releasably securing the speaker in the first position and a second detent releasably securing the speaker in the second position.

5. The wrestling headgear assembly according to claim 2, further comprising a generally planar middle layer fixedly attached to the inner layer, wherein the middle layer has a generally central middle opening aligned with the inner opening, the middle opening extending through the middle layer.

6. The wrestling headgear assembly according to claim 5, wherein the middle layer is located between the inner layer and the outer layer.

7. The wrestling headgear according to claim 6, wherein, when the speaker is in the first position, the speaker is between the outer layer and the middle layer.

8. A wrestling headgear assembly comprising:
a first ear piece; and
a second earpiece connected to the first earpiece by at least two connections, wherein each of the first and second earpieces comprises:
an inner layer constructed from a compressible material, wherein the inner layer has an ear hole extending therethough; and
a sound speaker located proximate to the inner layer such that sound generated by the speaker is transmitted through the ear hole.

9. The wrestling headgear assembly according to claim 8, further comprising a rigid layer extending over the speaker, the rigid layer being fixedly connected to the inner layer.

10. The wrestling headgear assembly according to claim 9, wherein the speaker is movable away from the ear hole.

11. The wrestling headgear assembly according to claim 9, wherein the rigid layer has a plurality of openings extending therethrough, the plurality of openings being disposed circumferentially around the speaker.

12. The wrestling headgear assembly according to claim 9, further comprising a middle layer located between the inner layer and the rigid layer, wherein the speaker is engaged with the middle layer.

13. The wrestling headgear assembly according to claim 12, wherein the speaker is pivotally connected to the middle layer.

14. The wrestling headgear assembly according to claim 8, further comprising a fabric material located between the inner layer and the speaker.

15. A wrestling headgear assembly comprising:
a first ear piece; and
a second earpiece connected to the first earpiece by at least two connections, wherein each of the first and second earpieces comprises:
a sound speaker coupled to the earpiece such that the speaker is movably located between a first position and a second position such that, when the speaker is at least in the second position, the speaker is located away from the ear;
an inner layer and an outer layer, and wherein, when the speaker is in the first position, the speaker is located between the inner layer and the outer layer; and
a fabric material located between the inner layer and the speaker when the speaker is in the first position.

16. The wrestling headgear according to claim 15, further comprising a middle layer located between the inner layer and the outer layer, wherein the speaker is pivotally engaged with the middle layer.

17. The wrestling headgear according to claim 15, wherein, when the speaker is in the second position, the speaker is not located between the inner layer and the outer layer.

18. The wrestling headgear assembly according to claim 17, wherein the outer layer includes a plurality of openings circumferentially spaced around the speaker when the speaker is in the first position.

* * * * *